United States Patent [19]

Mayall et al.

[11] Patent Number: 4,565,145

[45] Date of Patent: Jan. 21, 1986

[54] MARINE OBSERVATORY CRAFT

[76] Inventors: Phillip L. Mayall, 19 Garden Grove, Carrara, Queensland, Australia; Edward M. Whitten, 105 Tarawara Ave., Mudgeeraba, Queensland, Australia

[21] Appl. No.: 606,102

[22] Filed: May 2, 1984

[51] Int. Cl.[4] ..... B63B 1/12

[52] U.S. Cl. ..... 114/61; 114/66; 114/125

[58] Field of Search ..... 114/56, 61, 66, 78, 114/116, 121, 123, 125, 177, 274, 312, 330, 333

[56] References Cited

U.S. PATENT DOCUMENTS

| | | | |
|---|---|---|---|
| 385,656 | 7/1888 | Belisle | 114/66 |
| 1,324,880 | 12/1919 | Cronenberg | 114/333 |
| 3,667,415 | 6/1972 | Robbins | 114/333 |
| 4,411,213 | 10/1983 | Laukien | 114/333 |
| 4,423,695 | 1/1984 | Rougerie | 114/61 |
| 4,494,472 | 1/1985 | Rougerie | 114/66 |

FOREIGN PATENT DOCUMENTS

| | | | |
|---|---|---|---|
| 1177543 | 4/1959 | France | 114/312 |
| 2046673 | 11/1980 | United Kingdom | 114/66 |

*Primary Examiner*—Trygve M. Blix

*Assistant Examiner*—Stephen P. Avila

*Attorney, Agent, or Firm*—Sughrue, Mion, Zinn, Macpeak, and Seas

[57] ABSTRACT

A marine observatory craft for viewing of underwater locations includes a plurality of planing type hulls with viewing ports associated with each hull. There is also provided a plurality of transverse bulkheads dividing each hull into a plurality of separate internal compartments which are sealed from each other. In each internal compartment there is provided one or more ballast tanks which function as seat supports wherein each internal compartment includes a viewing area having one or more of the seat supports. A control cabin superstructure is located above the plurality of internal compartments. There is also provided a device for selectively flooding the ballast tanks whereby the craft may move in a traveling mode wherein the viewing ports are located above the waterline and an observing mode in which the viewing ports are located below the water line. The flooding device includes a pump, a plurality of valves for controlling the flow of water through flow conduits, an inlet and an outlet. There is also provided a feed conduit having separate communication conduits with each internal compartment and venting devices associated with each compartment.

6 Claims, 14 Drawing Figures

9
8
15
16
10
13
49
17
11
20
a
a
18
14
48

9
8
12
14
b
b
13
14
20
11
36 A
13
14
12
14

MARINE OBSERVATORY CRAFT

This invention relates to a marine observatory craft.

Hitherto marine observatory craft have been useful in relation to the observation of underwater locations such as coral reefs and also marine life especially of the type that abounds in sub-tropical and tropical climates. Usually such locations are relatively close to mainland resorts and it was necessary to transport tourists from the mainland to the underwater location of interest whereafter it was essential for tourists to transfer to small craft having glass bottoms in order to view the underwater location. The transport craft was normally a motorboat having an inboard or outboard engine. The use of small glass bottom boats was found to be generally satisfactory if the weather was fine, the tourists were reasonably young and agile, and the underwater locations were relatively close to the mainland.

It therefore will be appreciated that not all of the above conditions for use of small glass bottom boats were present on a particular day and thus use of glass bottom boats was not appropriate.

It further will be appreciated that the majority of less developed and therefore more interesting marine areas are inaccessible to the majority of tourists who are not scuba divers capable of operating off larger conventional vessels in the inaccessible or remote underwater locations.

United Kingdom specification 2046673 to Rambridge describes a partly submersible boat with a ballast tank or tanks in which water can be passed and viewing windows which lie partly or wholly below the surface of the water at least when the boat is partly submerged. The control cabin is located forwardly and on the same level as the passenger level and thus will always be at least partly submerged in the travelling mode. The water may be pumped into the ballast tanks or alternatively it may be scooped while the boat is in motion into the ballast tanks(s) via an inclined pipe. While mention is made in U.K. specification 2046673 to the fact that more than one ballast tank may be included in each hull there is no specific description of same in the drawings. Also there is no specific description of how the water may be pumped into or out of the ballast tanks.

U.K. Specification 2046673 only discloses a displacement hull which must at all times be located below the waterline when in a travelling mode. This means that the invention of U.K. specification 2046673 is only applicable to small boats and thus is not suitable for medium to large charter vesels because the boat of U.K. specification 2046673 may only travel in a ballasted state due to water always being present in the ballast tank(s). It is also believed that the Rambridge boat in having a control cabin on the same level as the passengers included in the or each hull will provide problems in relation to steering and handling as the driver or operator will not be in an elevated position to thereby provide effective handling control when either in the submerged mode or the travelling mode.

The Rambridge boat also requires the use of stabilizing floats for effective flotation and thus this provides a boat which is very unconventional in appearance and it is believed speculative in nature especially when no structural components such as bulkheads and the like are disclosed.

It is also noted in regard to the Rambridge boat that the ballast tanks are located on the bottom portion of each hull or alternatively in a bridging portion interposed between each hull and effectively the ballast cannot be carried in a position approximately centrally or middle of the height of the boat and it is therefore believed that will adversely effect submerging operations because the ballast tanks are therefore of limited storage capacity.

A further problem with the Rambridge boat is that each of the passenger viewing areas are fully enclosed and thus this will be deleterious to passenger comfort because of the fact that some passengers may experience a claustrophobic feeling when the boat is in a submerged condition.

The object of the present invention is to provide a marine observatory craft which alleviates the above-mentioned disadvantages associated with the prior art.

The marine observatory craft of the invention includes:

- one or more planning type hull;
- viewing means associated with the or each hull;
- one or more transverse bulkheads dividing the or each hull into a plurality of separate internal compartments which are sealed from each other;
- one or more ballast tanks included in each internal compartment which function as seat supports wherein each internal compartment includes a viewing area having one or more of said seat supports;
- a control cabin superstructure located above said plurality of internal compartments;
- means for selectively flooding said ballast tanks wherein the craft may move in
  - (i) a travelling mode wherein the viewing means is located above the waterline; and
  - (ii) an observing mode in which the viewing means is located below the waterline;
- said flooding means including pump means;
- valve means controlling flow of water through the pump means;
- an inlet;
- an outlet; and
- a feed conduit having separate communication conduits with each ballast tank in each internal compartment; and
- venting means associated with the or each compartment.

Suitably the craft is multi hulled and thus be in the form of a trimaran or catamaran. However, this does not preclude the fact that the craft may be mono-hulled if desired.

Preferably the craft is a catamaran having a pair of hulls separated by a body portion in the form of a cockpit or cabins or interconnecting part between each hull. The craft may be powered by an inboard or outboard engine.

The viewing means may comprise an elongate window located in each side of both hulls but more suitably the viewing means comprises a multiplicity of viewing ports located in each side of the or each hull.

Preferably there is a plurality of ballast tanks in each hull and these may be located under a row of seats provided on each side of the or each hull. Each ballast tank may extend above the waterline when the craft is in the travelling mode and may communicate with a base reservoir located in each hull which may be flooded before water may enter the ballast tanks.

The pump means may be of any suitable type. The conduit may be separate but more preferably there is provided a conduit that functions both as an inlet and an outlet. Each ballast tank may also be provided with a breather pipe to atmosphere.

Reference may now be made to the attached drawings which illustrate a preferred embodiment of the present invention.

In these drawings

Figure 2:
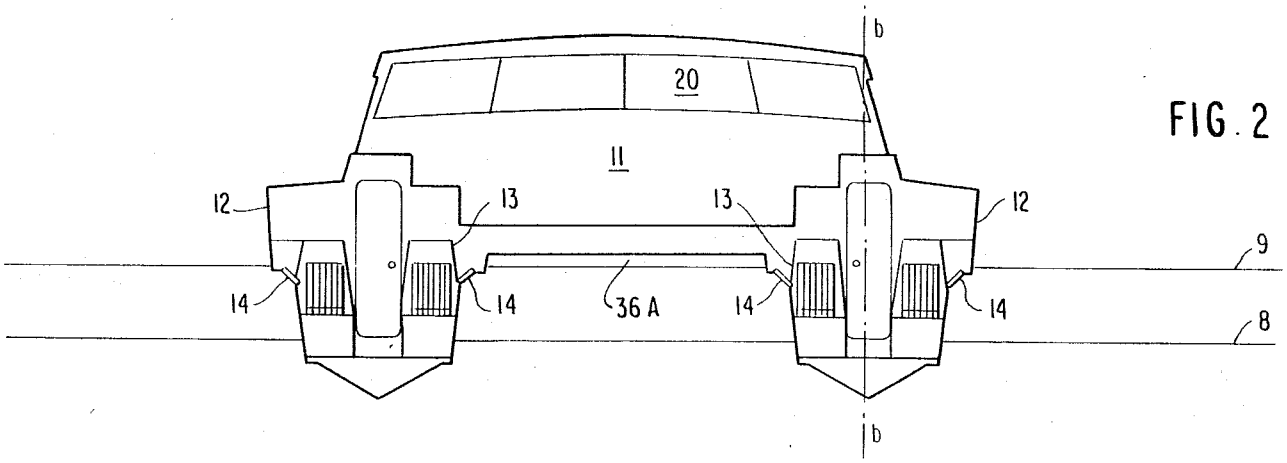
FIG. 2 is a schematic sectional rear view taken along the line a—a of the craft shown in FIG. 1.
Figure 3A:
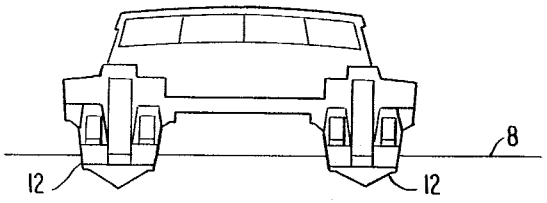
FIG. 3A is a rear view taken along the line c—c of FIG. 3.

In the drawings the marine craft 10 includes a cabin or cockpit 11 and opposed hulls 12. Each hull 12 on each side thereof is provided with a row of seats 13 and a row of viewing ports 14. Each port 14 as shown in FIG. 2 extends outwardly and upwardly from bottom to top and is located immediately adjacent to an associated seat 13. There is also provided bulkheads 15, 16, 17 and 18 as shown. Bulkhead 15 is a collision bulkhead and there is shown a door 19 communicating between the interior of each hull 12 and the interior of the front or bow of the craft 10. The cockpit includes windscreen 20.

Figure 8:
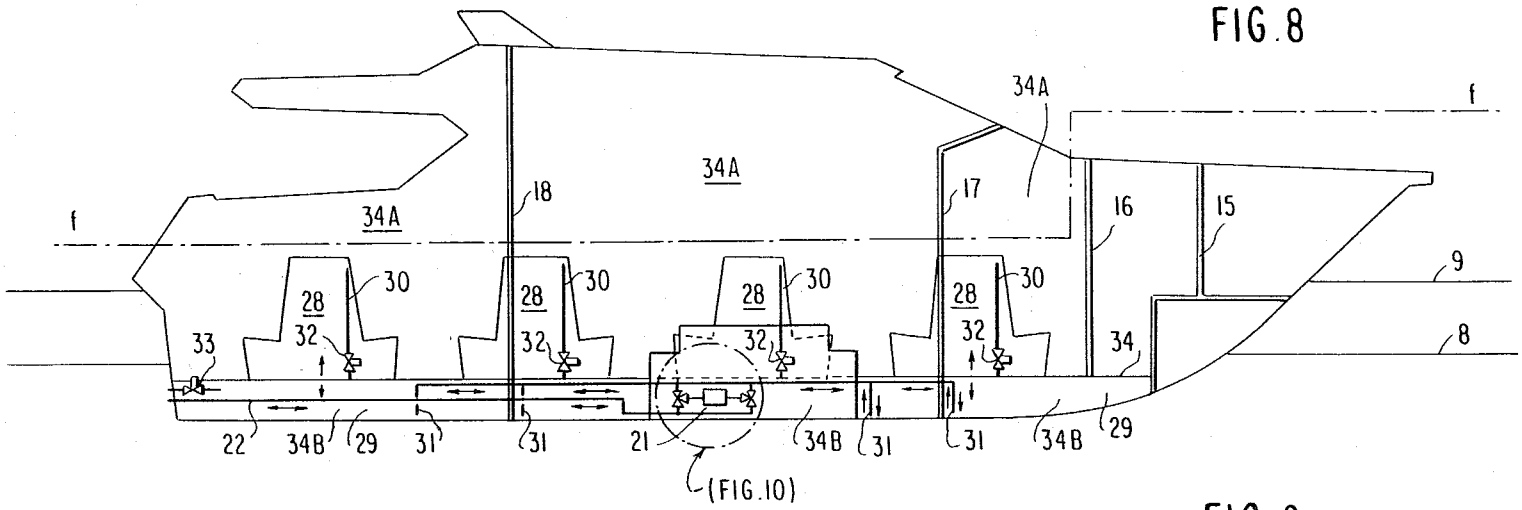
FIG. 8 is a side elevation view of the craft taken along the line g—g of FIG. 9.
Figure 9:
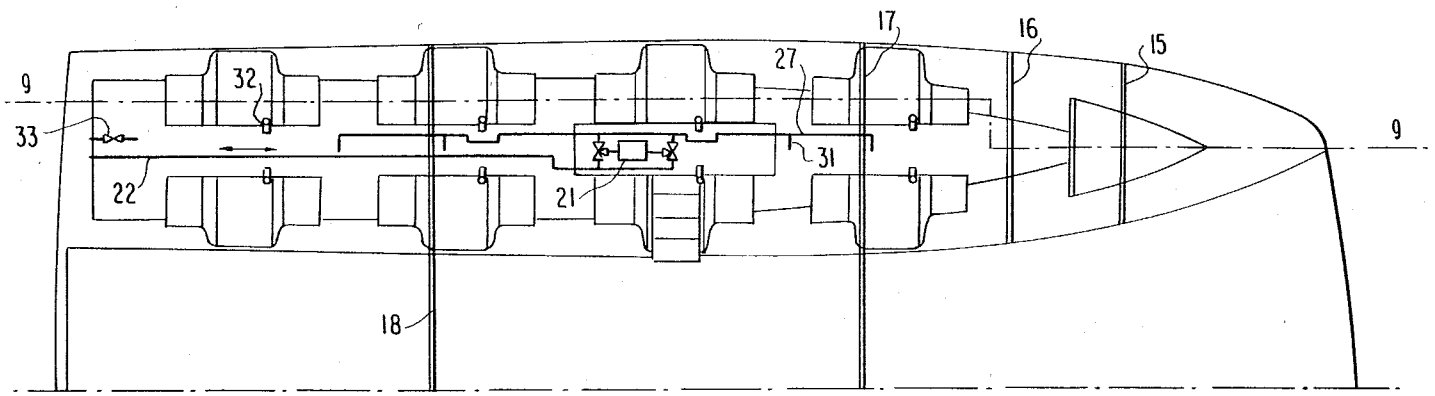
FIG. 9 is a plan view of the craft taken along the line f—f of FIG. 8.
Figure 10:
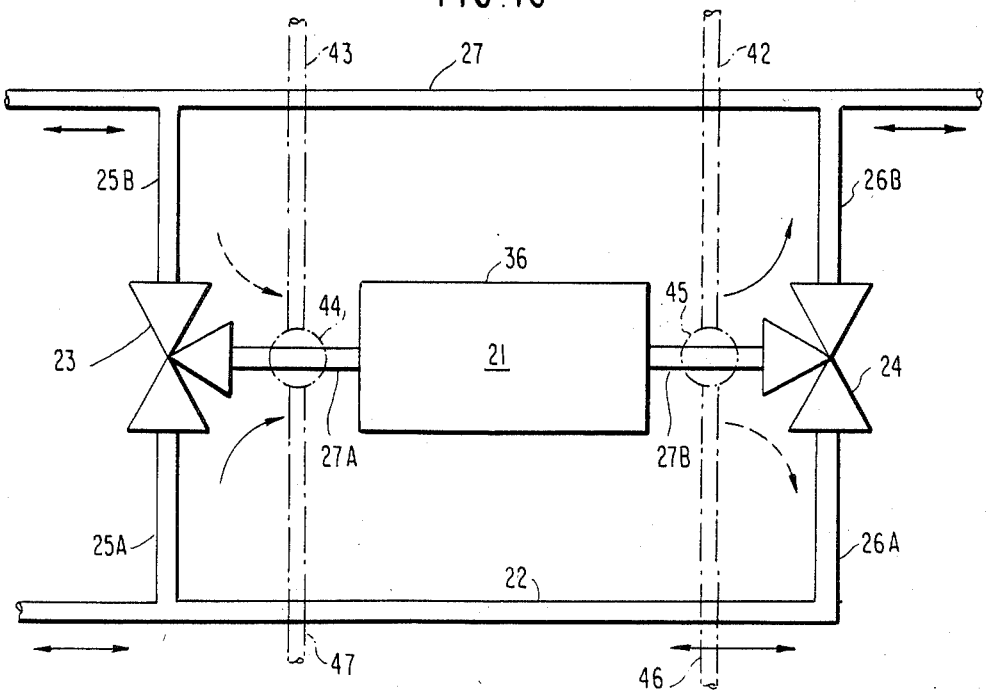
FIG. 10 is a schematic diagram of the apparatus for flooding shown in FIG. 8.

As best shown in FIGS. 8–10 there is shown pump 21 which may be of any suitable type such as a centrifugal pump or gear pump and a network of conduits comprising an inlet-outlet conduit 22, solenoid valves 23 and 24, conduits 25A, 25B, 26A and 26B and feed conduit 27 to ballast tanks 28 which form the interior of the hollow seats 13. There is also shown pump conduits 27A and 27B. Each solenoid valve 23 and 24 operate in unison and are actuated electronically from a control station (not shown). In FIG. 10 the flow of water for flooding is shown by arrows in full outline wherein the water flows sequentially through conduits 25A, 27A, 27B and 26B to conduit 27 and for deflooding or draining of water the flow of water is shown by arrows in dotted outline travelling through conduits 27, 25B, 27A, 27B and 26A to conduit 22.

There are also shown in the drawings base reservoir tanks 29 into which water enters when solenoids 23 and 24 are actuated to cause operation of pump 21 to draw water into reservoir tanks 29 through inlet-outlet conduit 22. In fact inlet-outlet conduit 22 is open to the sea and is kept permanently full of water so that pump 21 is self-priming.

There are also shown breather pipes 30 which are included in each ballast tank 28 which communicate with the reservoir 29. The breather pipes are useful in that they allow for venting of air from each ballast tank 28. The feed conduit 27 may deliver water as shown in FIGS. 8–9 through reservoir conduits 31 to reservoir tanks 29 and subsequently to ballast tanks 28. There is also shown spring loaded or pressure relief valves 32 which are associated with each breather pipe 30. The valves 32 are regulated intially in trails before being locked or set in position.

There is also shown spring loaded pressure relief valve 33 for ballast tanks 28 which may be actuated when the pressure in tanks 28 exceeds a predetermined safety level. The bulkheads 15, 16, 17 and 18 divide the hulls into compartments which in turn are divided into upper compartments 34A and lower compartments 34B separated by partition 34 which are fully sealed from each other in the event of the hulls being penetrated or holed. There is also shown housing 36 for pump 21 and struts 36A interconnecting hulls 12.

In operation of the flooding of the ballast tanks the solenoids 23 and 24 are actuated which actuate pump 21 to draw water from conduit 22 into feeder conduit 27 as previously described and hence through conduits 31 to reservoir 29 and hence into ballast tanks 28.

Figure 4A:
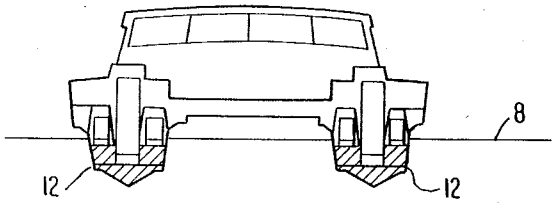
FIG. 4A is a rear view taken along the line c—c of FIG. 4.
Figure 5A:
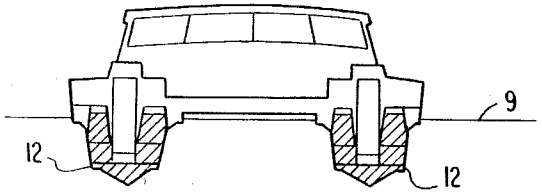
FIG. 5A is a rear view taken along the line c—c of FIG. 5.
Figure 3:
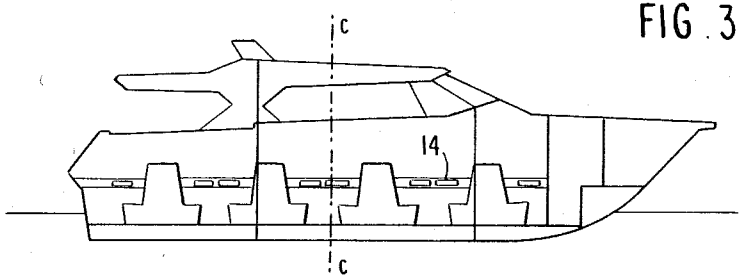
FIG. 3 is a side view similar to FIG. 1 showing the ballast tanks of the craft in an unflooded state and in the travelling mode.
Figure 4:
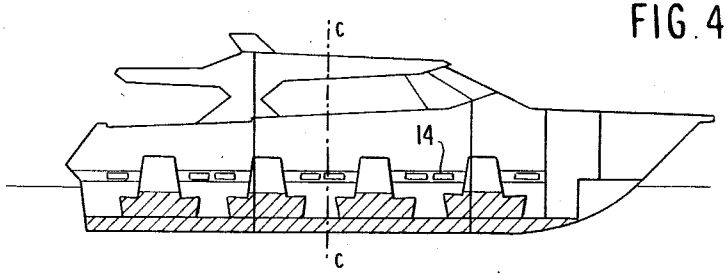
FIG. 4 is a side view similar to FIG. 1 showing the ballast tanks of the craft in a partially flooded state and thus between a travelling mode and an observing mode.
Figure 5:
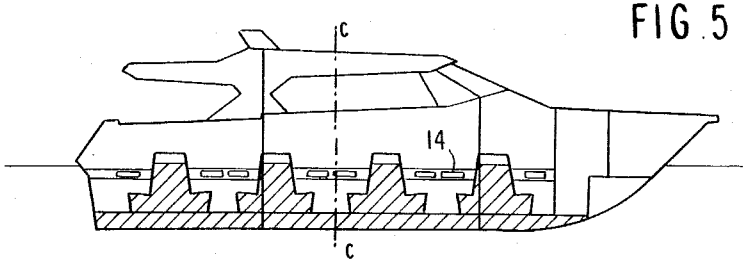
FIG. 5 is a side view similar to FIG. 1 showing the ballast tanks of the craft in a substantially fully flooded state and in the observing mode.
Figure 6:
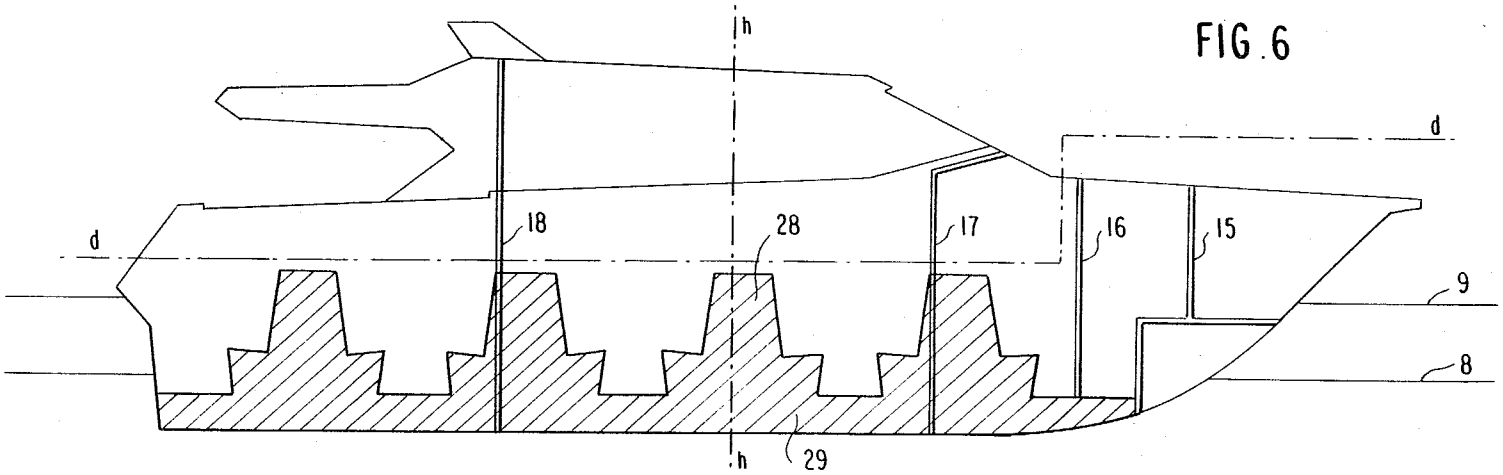
FIG. 6 is a side elevation view of the craft taken along the line e—e of FIG. 7.
Figure 7:
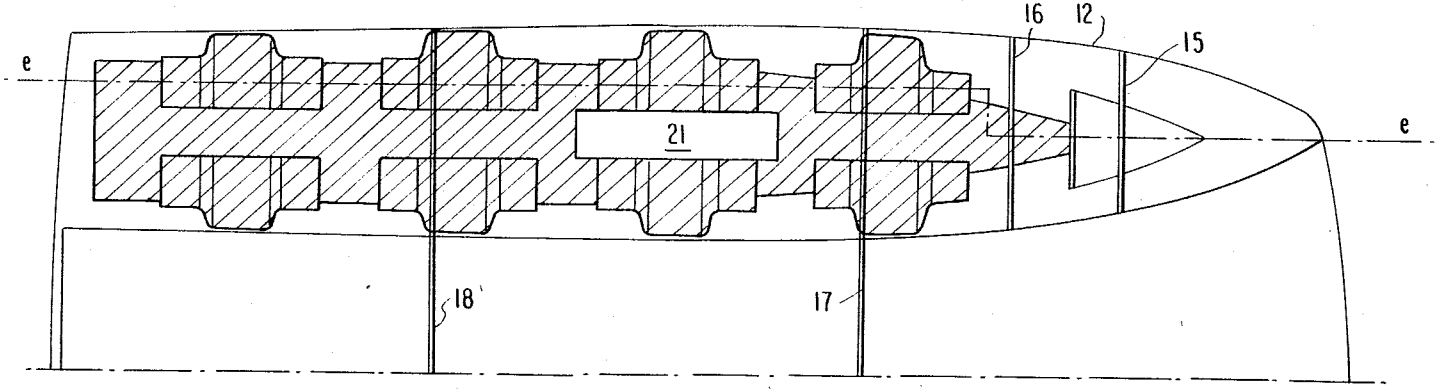
FIG. 7 is a plan view of the craft taken along the line d—d of FIG. 6.

By operation of solenoids 23 and 24 it will be appreciated that the ballast banks may only be partially flooded if required as shown in FIGS. 3, 3A, 4, 4A, 5 and 5A. In these figures FIGS. 3–3A the craft 10 is in the travelling mode indicated by the waterline 8 when reservoir 29 and ballast tanks 28 are unflooded. In FIGS. 4–4A the ballast tanks 28 are shown partially flooded and thus the craft 10 has effectively undergone a downward displacement until a fully flooded position is shown in FIGS. 5–5A when the craft 10 is in an observing mode indicated by the waterline 9 where the location of the ports under the waterline facilitate the viewing of undersea locations by passengers sitting on seats 13.

One of the features of the invention as described above is the provision of ballast tanks 28 being built as a normal part of the seating accommodating in the underwater viewing area in such a manner as to provide effective flood bulkheading of each individual viewing area 34A so that in the event of holing the craft on a reef or the impacting of a viewing port against a reef only that individual area 34A will flood without any further danger to the craft 10.

The provision of ports having a sloping orientation as shown is relative to the sea surface is useful in that it enables the viewer to obtain a sight of underwater areas vertically under the vessel without the need to provide viewing ports on the hull base which would otherwise present an undesirable safety hazard in vessels used in reef areas.

Figure 11:
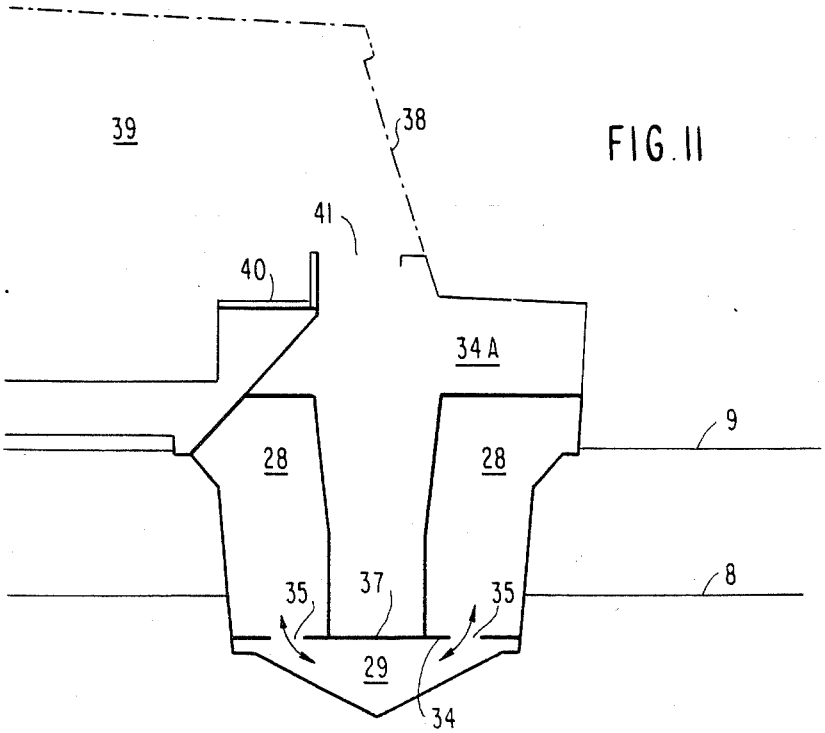
FIG. 11 is a schematic sectional view along the line h—h of FIG. 6.

In FIG. 11 there are shown ports 35 located in partition 34 allowing flow of water from reservoir tanks 29 to ballast tanks 28 in each compartment 34B. Also shown is floor portion 37 of partition 34.

Furthermore the hull shape is contoured both to provide marine stability and to prevent halation or clouding effect due otherwise to direct sunlight effects upon the glass water interface which would prevent clear viewing. The craft 10 may include a system of freely rotatable underwater spotlights for night viewing or by the ships crew from a master panel.

In order to allow activities such as underwater feeding of fish by scuba divers or to provide easy access for tourist scuba divers to the water a hydraulically operated self contained fold away ladder system may be integrated into the bow interior if required.

The craft 10 is suitably designed as a planing hull utilising engines of the correct horsepower to provide a cruising speed of at least 15 knots. While a catamaran type hull is described in the preferred embodiment because it offers maximum viewing areas, an ability to plane in reasonably heavy seas, a good upper tourist servicing and accommodation area, and the ability to be easily bulkheaded to conform to Lloyds codes for charter vessels, along with excellent safety factors in the event of accidental impact with reef areas it should be understood that the semi submarine principle for bulk transportation and combined underwater viewing facilities could be applied to hydrofoils, mono-hulls, trimaran hulls or similar embodiments designed un such a manner as to take advantage of the specific technical features and advantages to charter operators and passengers. While it is intended to cover the building of the craft 10 in marine grade aluminium it should be understood that it is not intended that the preferred or optional embodiments shall be limited to this material but could be produced in fibreglass, steel, other metals, ferro cement, ferralite, plastic or any known and acceptable form of seagoing vessel construction.

As best shown in FIG. 11 is cockpit roof 38 enclosing interior cabin 39 located above upper compartment 34B of each hull 12. Cabin 39 has seats 40 as shown and passengers sitting on seats 40 may look into compartment 34 by observation through space 41 as shown.

As best shown in FIG. 8 the top of breather pipes 30 stop just short of ballast tanks 28 to allow displaced air to flow downwardly into reservoir or bilge tanks 29. Thus the valve 33 in the transom of the craft 10 will be operable upon attainment of a pressure in excess of the recommended safety level.

Figure 1:
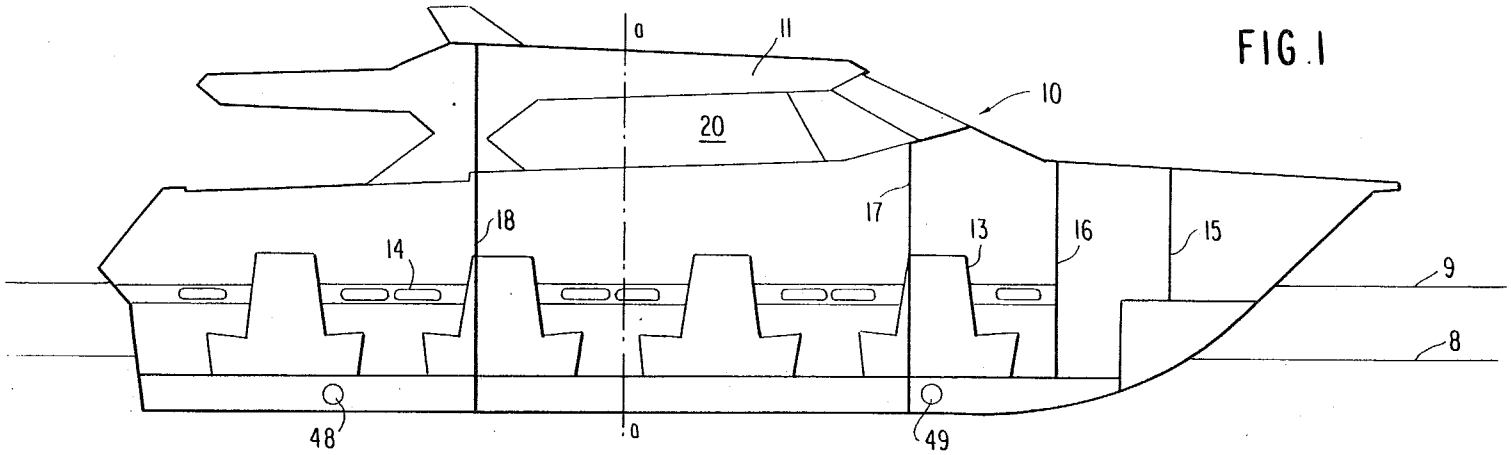
FIG. 1 is a schematic sectional side elevation view of a marine observatory craft constructed in accordance with the present invention and taken along the line b—b of FIG. 2.

There is also shown in schematic outline in FIG. 10 conduits 42, 43, 46 and 47 which provide for lateral jets of water to be exited from the craft 10 when in a submerged mode for lateral or sideways movement when required. Forward conduit 46 exits through outlet port 49 and rear conduit 47 exits through outlet port 48 shown in FIG. 1. Thus conduits 46 and 47 provide for jets of water to exit outwardly of each hull 12 and conduits 42 and 43 provide for jets of water to exit inwardly from each hull 12. Conduits 42 and 43 are optional and may be dispensed with if required. Movement of water through conduits 42, 43, 46 and 47 may be controlled by valves 44 and 45 when water flows through conduits 27A and 27B as shown.

The present invention by being limited to planing type hulls thus provides a vessel of medium to large size for use as a charter vessel and thus in the cruising mode may travel in an unballasted condition which is contrary to the prior art described previously. This also provides an extremely fast craft which is quickly submerged as described previously when required.

Also by providing a cockpit or control cabin superstructure 11 atop hulls 12 this enables passengers in compartments 34B to sit in a fully open situation without obtaining any closed in or claustrophobic feeling as would be the case with a fully enclosed compartment or capsule. This also provides a craft which may be readily handled or controlled when required and provides a high observation point for passengers when required.

The term "planing type hull" as used herein means hulls which may rise above their normal stationary waterline under the influence of power. Thus in this manner the wetted surface of the or each hull is reduced in a travelling mode.

Another advantage of the craft of the invention is that provision is made for lateral movement when required especially when in an observing mode.

It will also be noted that flooding or ballasting operations may be controlled automatically if desired by levelling sensors of any suitable type such as electronic, mechanical, electrical, hydraulic or gyroscopic sensors. The sensors may actuate operation of the valves as previously discussed which may be gate valves but are more suitably rotary valves.

We claim:

1. A marine observatory craft for viewing underwater locations comprising a pair of parallel spaced apart planing type hulls, viewing means located in each hull, at least one transverse bulkhead dividing each hull into a plurality of separate internal compartments which are sealed from each other, at least one ballast tank disposed in each internal compartment and defining a seat located adjacent said viewing means, a control cabin superstructure interconnecting said hulls and located above each of said plurality of internal compartments in direct open communication therewith, and means for selectively flooding and emptying said ballast tanks whereby said craft may be disposed in an observing mode in which the viewing means is located below the water line and a travelling mode wherein the viewing means is located above the water line respectively.

2. A marine observatory craft as set forth in claim 1 wherein said craft is a catamaran and said viewing means comprises at least one row of spaced viewing ports in each hull.

3. A marine observatory craft as set forth in claim 2 wherein said viewing means is adapted to slope outwardly and upwardly from the bottom to the top thereof so as to facilitate viewing of underwater locations substantially directly beneath the craft.

4. A marine observatory craft as set forth in claim 1 wherein each compartment includes a base reservoir tank disposed in communication with each ballast tank in each compartment.

5. A marine observatory craft as set forth in claim 1 wherein said flooding means includes pump means, an inlet, an outlet, valve means controlling the flow of water through said pump means and a feed conduit disposed in separate communication with each ballast tank and venting means associated with each ballast tank.

6. A marine observatory craft as set forth in claim 5 wherein said valve means includes first and second valves in communication with said pump means and arranged to operate in unison whereby upon flooding of said ballast tanks water will pass in sequence through said first valve, said pump means and said second valve to said feed conduit and whereby upon draining of said ballast tanks water will flow in sequence through said feed conduit, said first valve, said pump means, said second valve and said outlet conduit.

* * * * *